US006761044B2

(12) United States Patent
Samuels

(10) Patent No.: US 6,761,044 B2
(45) Date of Patent: Jul. 13, 2004

(54) GEMSTONE CUT

(75) Inventor: Stuart Samuels, Woodmere, NY (US)

(73) Assignee: Premier Gem Corp, New York, NY (US)

( * ) Notice: Subject to any disclaimer, the term of this patent is extended or adjusted under 35 U.S.C. 154(b) by 0 days.

(21) Appl. No.: 10/120,771

(22) Filed: Apr. 11, 2002

(65) Prior Publication Data

US 2003/0192346 A1 Oct. 16, 2003

(51) Int. Cl.[7] ..... A44C 17/00
(52) U.S. Cl. ..... 63/32; D11/89; D11/90
(58) Field of Search ..... 63/32; D11/89, D11/90

(56) References Cited

U.S. PATENT DOCUMENTS

| | | | | |
|---|---|---|---|---|
| 693,084 | A | 2/1902 | Townsend | |
| 3,585,764 | A | 6/1971 | Huisman et al. | |
| 3,763,665 | A | * 10/1973 | Polakiewicz | 63/32 |
| 3,788,097 | A | 1/1974 | Elbe | |
| 4,020,649 | A | 5/1977 | Grossbard | |
| 4,083,352 | A | 4/1978 | Andrychuk | |
| 4,118,949 | A | 10/1978 | Grossbard | |
| 4,308,727 | A | 1/1982 | Elbe | |
| D286,387 | S | * 10/1986 | Ishida | D11/90 |
| D286,388 | S | * 10/1986 | Ishida | D11/90 |
| D366,628 | S | 1/1996 | Grossbard | |
| D419,104 | S | 1/2000 | Ceulemans | |
| 6,305,193 | B1 | 10/2001 | Cheng | |
| D453,705 | S | * 2/2002 | Habif | D11/90 |
| 6,397,832 | B1 | * 6/2002 | Shuto | 125/30.01 |
| D462,030 | S | * 8/2002 | Rydlewicz | D11/90 |
| D469,034 | S | * 1/2003 | Yuan | D11/90 |
| D475,650 | S | * 6/2003 | Wueste | D11/90 |

OTHER PUBLICATIONS

"Some of the Principal Shapes into Which Diamonds are Cut" from Jeweler's Circular Keystone p. 78 Apr. 1966.*

* cited by examiner

*Primary Examiner*—Andrea Chop
*Assistant Examiner*—Thomas Ho
(74) *Attorney, Agent, or Firm*—Katten Muchin Zavis Rosenman

(57) ABSTRACT

A novel gemstone cut comprising a crown, a girdle, and a pavilion, wherein the gemstone includes precious gemstones (such as diamonds) and semi-precious gemstones. The crown includes an octagonal table, which is surrounded by eight triangular star facets. Eight table bezels are disposed in-between the star facets and eight mid-bezels are disposed in-between the table bezels. Furthermore, the gemstone's pavilion has eight concentrically arranged culet pavilion facets, a girdle pavilion facet and a bottom small break facet that are disposed in-between the culet pavilion facets. The gemstone's girdle has eight left top half facets and eight right top half facets (located in-between the girdle bezels of the crown), and eight left bottom half facets and eight right bottom half facets (disposed in-between the girdle pavilion facets and bottom small break facets).

24 Claims, 21 Drawing Sheets

| Facet Name | Polishing Angle | Range |
|---|---|---|
| Star Facet | 14.016 | 4.0 to 16.0 |
| Table Bezel | 20.000 | 12.0 to 24.0 |
| Mid-Bezel | 26.180 | 24.0 to 32.0 |
| Girdle-Bezel | 45.579 | 36.0 to 50.0 |
| Top-Half Facet | 54.087 | 47.0 to 67.0 |
| Bottom-Half Facet | 55.673 | 50.0 to 61.0 |
| Small Break Facet | 45.536 | Has little effect |
| Pentagonal Girdle Pavilion | 47.800 | 39.0 to 54.0 |
| Kite-Shaped Facet | 22.500 | N/A |
| Triangular Facet | 09.257 | N/A |
| Index Angle | 45.000 | N/A |
| Culet Pavilion Angle | 39.000 | 35.0 to 42.0 |

FIGURE 6b

1002 {PH3 = 0.82}

Note: PH3 > PH1

Pref. emb. depth ratio= ?

GEMSTONE CUT

BACKGROUND OF THE INVENTION

1. Field of Invention

The present invention relates generally to gemstones. More specifically, the present invention is related to a gemstone cut.

2. Discussion of Prior Art

Diamonds are one of the most popular gemstones. One measure of the quality of a diamond is related to the cut of the diamond. The better the cut of a diamond, the higher the quality of light reflected and thus an increase in the brilliance.

FIG. 1 illustrates the general structure associated with a diamond. The basic structure can be divided into three sections: a crown 102 which forms the upper section of the diamond, a pavilion 104 which forms the lower section of the diamond, and a girdle 106 which forms the rim separating the crown from the pavilion.

FIG. 2 illustrates a prior art gemstone cut as described in U.S. Pat. No. 693,084. The patent provides for a diamond, or other precious stone having a series of quadrilateral facets a, meeting in the center, at an elevation to form an apex, a series of quadrilateral facets a', surrounding the series of quadrilateral facets. A second series of quadrilateral facets $a^2$, surrounds the facets a' and extends to the girdle, and triangular girdle facets $a^3$ fills the space between the points of the facets $a^2$ and the girdle.

The U.S. patent to Huisman (U.S. Pat. No. 3,585,764) provides for a method of cutting a diamond to produce 72 pavilion facets comprising the steps of: 1) cutting four pavilion facets, 2) dividing the four into eight pavilion facets, 3) cutting the eight into sixteen pavilion facets with substantially overlapping edges, 4) polishing the girdle to a 90° edge, 5) cutting a facet at 53° at each overlap, 6) dividing each such latter facet into three facets such that each latter facet is provided with a diamond shape, and 7) cutting 38 facets into the girdle.

The U.S. patent to Elbe (U.S. Pat. No. 3,788,097) provides for a brilliant gem having upper and lower facets which are inclined to a girdle plane and formed by lateral surfaces of a pyramid. The angles between the lower facets and the girdle plane ranges from 37° to 45°, and are selected such that emerging light is dispersed in a dispersion angle from 1° 20 minutes to 12° 57 minutes. The gem is also provided with a second plane parallel to the girdle plane, and contains an odd number of upper and lower facets in a ring of facets circling the gem.

The U.S. patent to Grossbard (U.S. Pat. No. 4,020,649) provides for a step cut gemstone with a straight edged polygonal shaped girdle that has a generally pyramidal base and a crown with girdle and table breaks, wherein at least one of these breaks is cut with triangular shaped facets. The angle between the plane of the girdle break of the crown and the table should be in the range from 35° to 42°.

The U.S. patent to Andrychuk (U.S. Pat. No. 4,083,352) provides for a method for systematically and accurately increasing the brilliance and depth of color of a gemstone without the need to determine the pavilion and facet angles by trial and error.

The U.S. patent to Grossbard (U.S. Pat. No. 4,118,949) provides for a brilliantized step cut diamond that has a straight edged polygonal shaped girdle with sides and corner facets; a crown with table and a table-and-girdle breaks which are faceted; and a pyramidal base having a point culet, a culet break and a girdle break with ridges extending from the culet to the corner of the girdle. A fan with three pairs of triangular halves is disposed symmetrically about each ridge with a triangular facet in each corner of the base having an edge which is collinear with the edge of a corner facet and an apex at a ridge. The angles between the culet break and the plane of the girdle is between 30° and 43°.

The U.S. patent to Elbe (U.S. Pat. No. 4,308,727) provides for a jewel of a brilliant type wherein a first plurality of facets are provided on the bezel and include an annular facet region whose facets are larger than 50° and up to 90°, and another annular facet region whose facets extend from the first mentioned region towards the table and are inclined to the girdle at angles smaller than 25°. A second plurality of facets is also provided on the pavilion and includes a further annular region of facets, which are included to the girdle at angles between 25° and 52°.

The U.S. patent to Cheng (U.S. Pat. No. 6,305,193 B1) provides for a gemstone that includes a pavilion portion, a crown portion and a girdle portion provided between the pavilion and the crown. The crown portion includes a plurality of facets provided on the surface and the crown portion has eight longitudinal sections, which collectively define it.

Whatever the precise merits, features and advantages of the above cited references, none of them achieve or fulfills the purposes of the present invention.

SUMMARY OF THE INVENTION

The present invention provides for a novel gemstone cut wherein the gemstone comprises a crown, a girdle, and a pavilion, each of which have facets disposed on them. The crown further comprises an octagonal table, which is surrounded by eight triangular star facets. In the preferred embodiment, the polishing angle of the star facets is 14.016°. In-between the star facets are disposed eight table bezels and in-between the table bezels are disposed eight mid-bezels. In the preferred embodiment, the polishing angles associated with the table bezels and the mid-bezels are 20° and 26.18° respectively. Lastly, in-between the mid-bezels are disposed eight girdle bezels that are close to the girdle. In the preferred embodiment, the polishing angle associated with the girdle bezel is 45.579°.

The pavilion of the present invention's gemstone cut comprises eight concentrically arranged culet pavilion facets, and in-between the culet pavilion facets are disposed a girdle pavilion facet and a bottom small break facet. In the preferred embodiment, the polishing angles associated with the culet pavilion facet, girdle pavilion facet, and culet pavilion facet are 39°, 47.8°, and 45.536° respectively.

The girdle of the present invention's gemstone cut comprises eight left top half facets and eight right top half facets located in-between the girdle bezels of the crown, and eight left bottom half facets and eight right bottom half facets disposed in-between the girdle pavilion facets and bottom small break facets. In the preferred embodiment, the top half facets (left and right) have a polishing angle of 54.087° and the bottom half facets (left and right) have a polishing angle of 55.673°.

Additionally, the gemstone of the present invention can be a precious or a semi-precious stone. In the preferred embodiment, the gemstone is a diamond.

BRIEF DESCRIPTION OF THE DRAWINGS

FIGS. 6*a* and 6*b* collectively illustrate various parameters associated with the gemstone of the FIG. 5.

DESCRIPTION OF THE PREFERRED EMBODIMENTS

Figure 1:
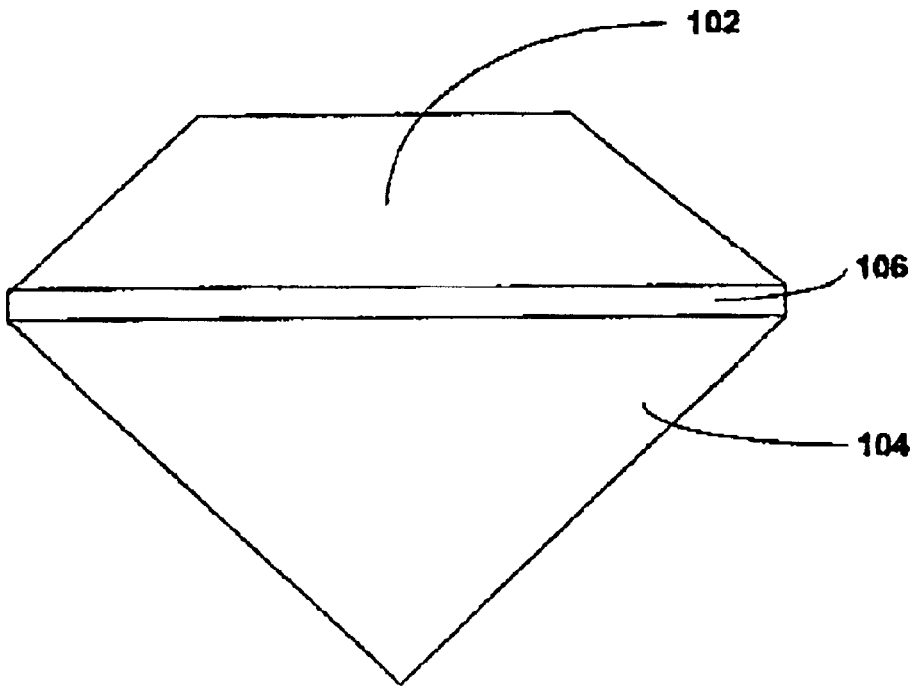
FIGURE 1 PRIOR ART
FIG. 1 illustrates a general structure associated with a diamond.
Figure 2:
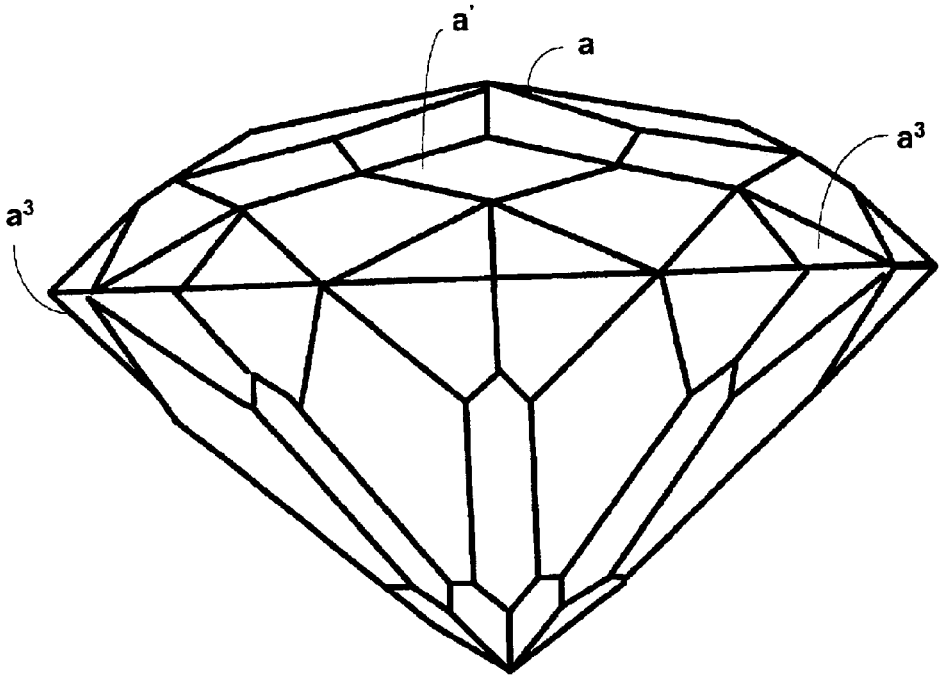
PRIOR ART FIGURE 2
FIG. 2 illustrates a prior art diamond cut.

While this invention is illustrated and described in a preferred embodiment, the gemstone may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention.

It should be noted that the gemstone of the present invention can be a precious stone or a semi-precious stone, but in the preferred embodiment, the gemstone is a diamond. Thus, the type of gemstone should not be used to restrict the scope of the present invention. Furthermore, the specific parameters (e.g., depths, heights, ratios, and angles) are used for illustrative purposes only and should not be used to limit the scope of the present invention. Additionally, the shape of the gemstone in the figures corresponding to the specification and the preferred embodiment are for illustrative purposes only, and one skilled in the art can envision using other shapes (e.g., an oval shape, a marquis shape, etc.).

Figure 3A:
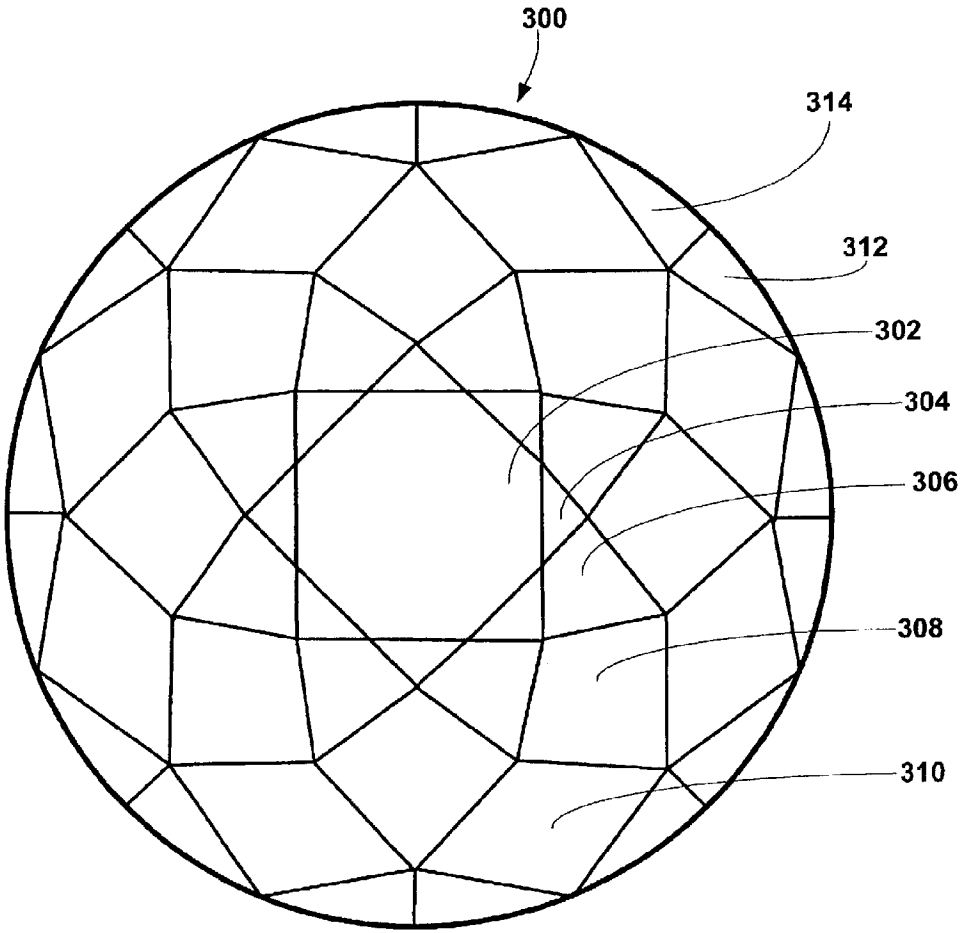
FIGS. 3*a* and 3*b* collectively illustrate the top view of the present invention's gemstone crown, including a part of the girdle.
Figure 3B:
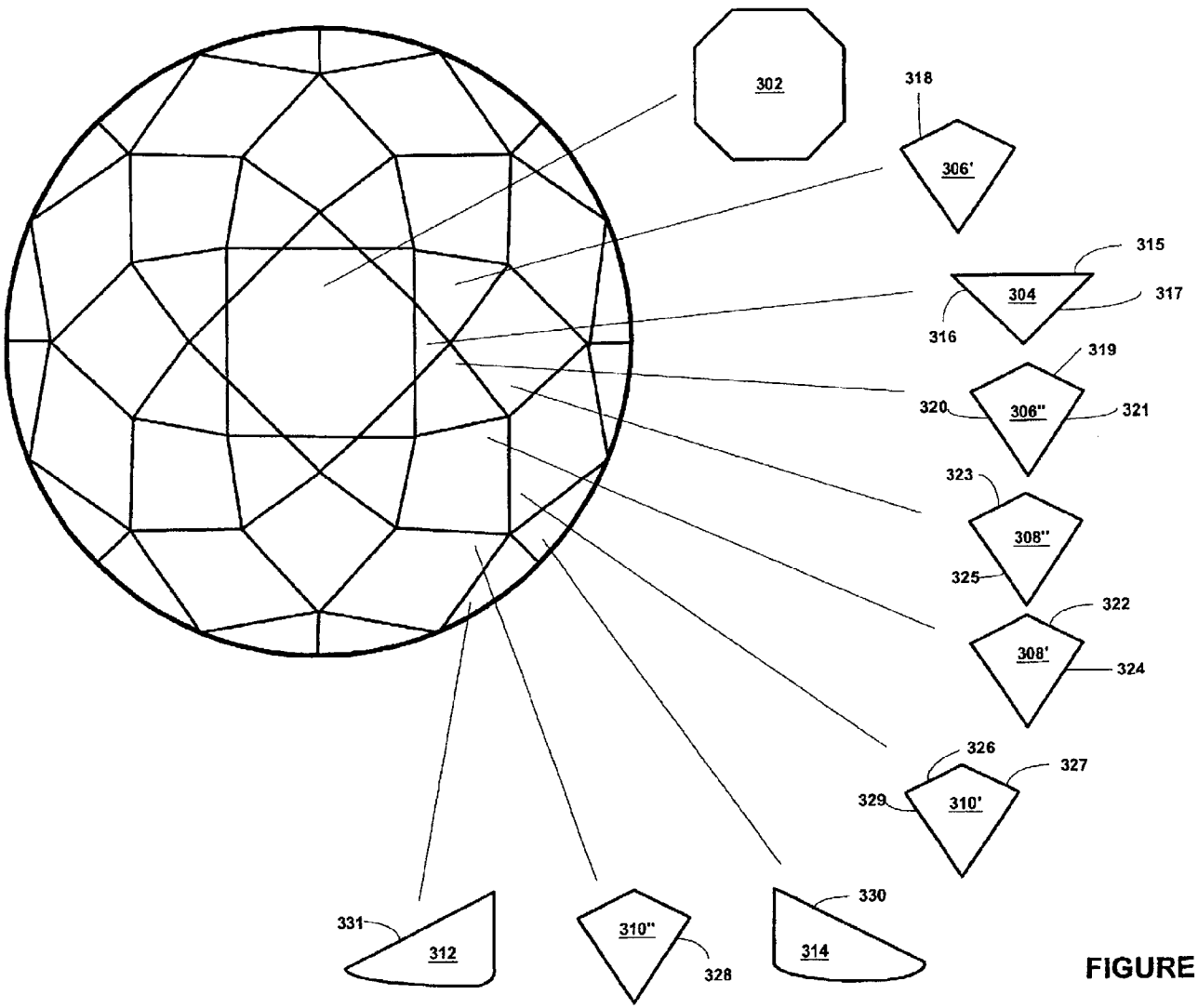

FIGS. 3*a* and 3*b*, collectively, illustrate crown 300 of the gemstone of the preferred embodiment of the present invention. FIG. 3*a* illustrates a top view of crown 300 with its various facets. Crown 300 includes a flat table 302 shaped like an octagon and is disposed at the top of the crown 300. Also disposed on the diagonally extended side of crown 300 are facets, which include: star facets 304, table bezels 306, mid-bezels 308, girdle bezels 310, and top half facets 312, and 314.

FIG. 3*b*, on the other hand, provides for a top view of the crown of the present invention's gemstone, including views of facets provided on the crown. Provided for in the crown 300 are an octagonal table 302 and eight star facets 304, each having the shape of a triangle. Edge 315 from each of the eight star facets 304 (a side from each of the triangles) forms the octagonal table 302. A right 317 edge of the star facet 304 forms a shorter left edge 318 of a respective table bezel 306' and a left edge 316 of the star facet 304 forms a shorter right edge 319 of another respective table bezel 306".

A long left edge 320 of table bezel 306" forms a shorter right edge 322 of mid-bezel 308' and a long right edge 321 of table bezel 306" forms a shorter left edge 323 of another mid-bezel 308". Additionally, a long left edge 325 of mid-bezel 308" and a long right edge 324 of mid-bezel 308' form a right edge 327 and a left edge 326 of girdle bezel 310' respectively.

Furthermore, the left edge 329 of mid-bezel 310' forms a side 330 of the right top half 314 of the girdle and the right edge 328 of mid-bezel 310" forms a side 331 of the left top half 312 of the girdle.

As mentioned earlier, the octagonal table is surrounded by eight triangular star facets, one for each side of the octagonal table. In the preferred embodiment, the star facets are angled downwardly at 14.06° from the plane of the octagonal table. Additionally, eight table bezels are formed in-between the area formed by the star facets. In the preferred embodiment, the table bezels are angled downwardly at 20° from the plane of the octagonal table. Eight mid-bezels are formed in-between table bezels. In the preferred embodiment, the mid-bezels are angled downwardly at 26.18° from the plane of the octagonal table. Eight girdle bezels are formed in-between the mid-bezels. Fifteen top halves are formed in-between the girdle bezels. In the preferred embodiment, the top halves of the crown are angled downwardly at 54.087° from the plane of the octagonal table.

Figure 4A:
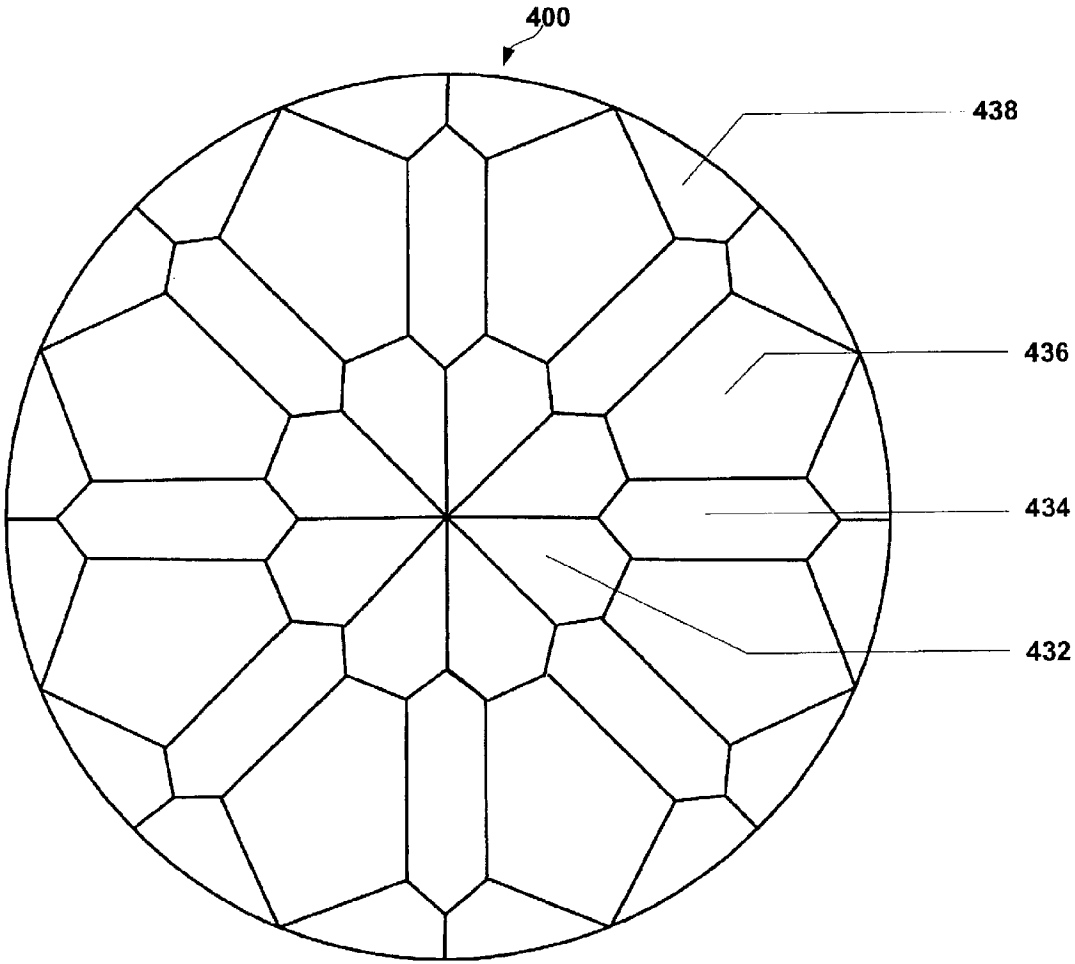
FIGS. 4*a* and 4*b* collectively illustrate a bottom view of the present invention's gemstone pavilion, including a part of the girdle.
Figure 4B:
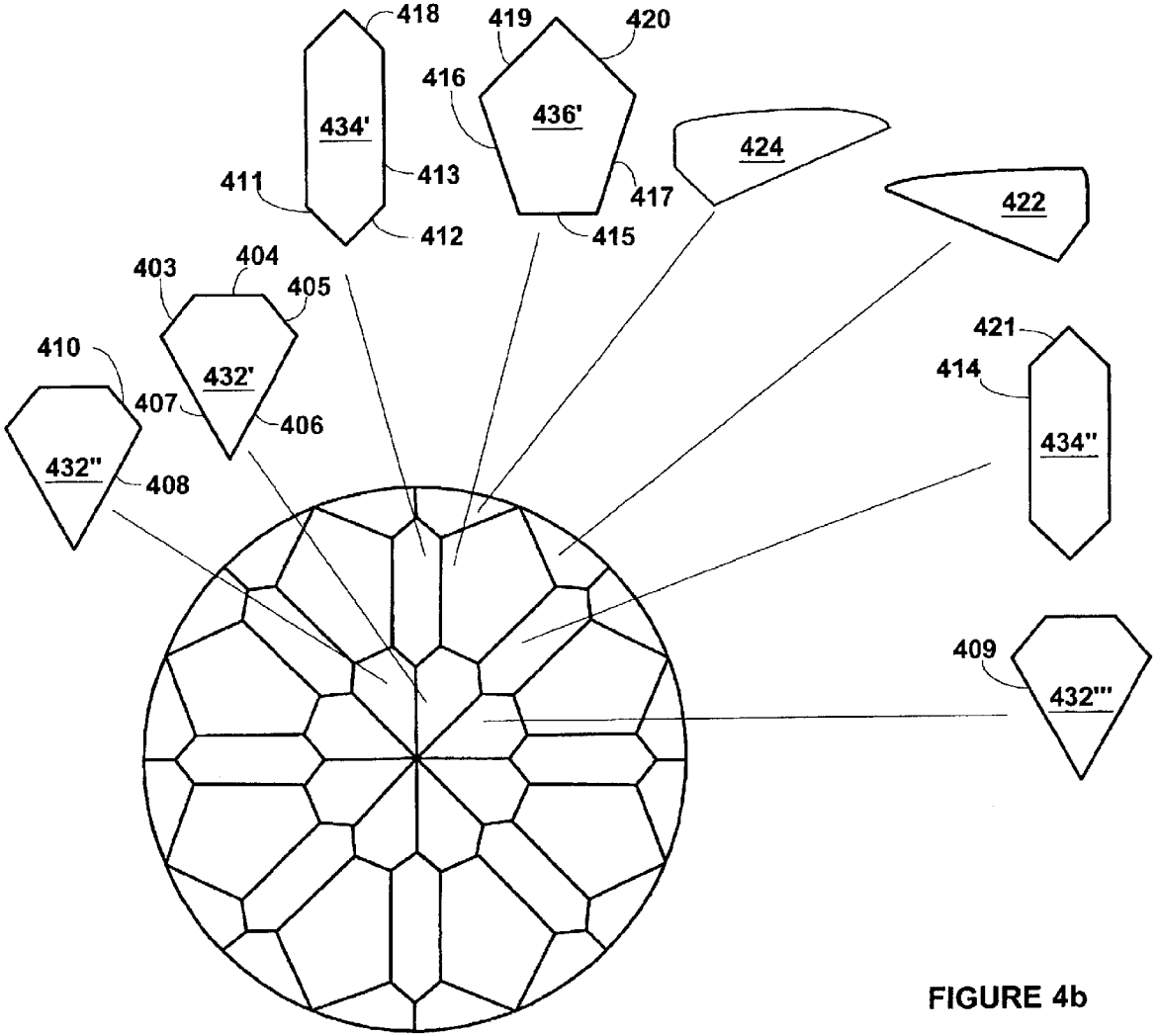

FIGS. 4*a* and 4*b* collectively illustrates a bottom view showing a pavilion portion of the present invention's gemstone in the preferred embodiment. FIG. 4*a* illustrates the pavilion 400 with various facets including culet pavilion facet 432, bottom small break facet 434, and girdle pavilion facet 436. A pair of bottom half facets 438 is also shown, which form a part of the girdle.

FIG. 4*b* on the other hand provides for a top view of the crown of the gemstone of the present invention including views of facets provided on the crown. Towards the center of the pavilion are eight concentrically arranged culet pavilion facets. A long bottom left edge 407 of culet pavilion facet 432' forms a long bottom right edge 408 of culet pavilion facet 432", and in a similar way, a long bottom right edge 406 of culet pavilion facet 432' forms a long bottom left edge 409 of culet pavilion facet 432'".

The short top right edge 410 of culet pavilion facet 432" and the short top left edge 403 of culet pavilion facet 432' form the bottom left edge 411 and bottom right edge 412 of the bottom small break facet 434' respectively. Furthermore, the top edge 404 of culet pavilion facet 432', the right edge 413 of bottom small break facet 434', and the left edge 414 of bottom small break facet 434'" form the bottom 415, the left edge 416 and the right edge 417 of the girdle pavilion facet 436'.

Additionally, the top edges 418, 419, 420, and 421 (corresponding to the bottom small break facets 434', 434" and girdle pavilion 436') form the edges for the left and right bottom half facets 422 and 424 of the girdle.

In summary, eight culets are formed at the center and extend outward. The culets are surrounding by eight hexagonal bottom small break facets and eight pentagonal girdle pavilions. In the preferred embodiment, the culets are angled downwardly at 39° from the plane of the pentagonal table and the bottom small break facets and pentagonal girdle pavilions are angled downwardly at 45.536° and 47.8° respectively. Lastly, sixteen bottom halves are cut between the bottom small break facet and the girdle pavilion facet. In the preferred embodiment, the bottom half facets of the pavilion are angled upwardly at 55.673° from the plane of the octagonal table.

Figure 5:
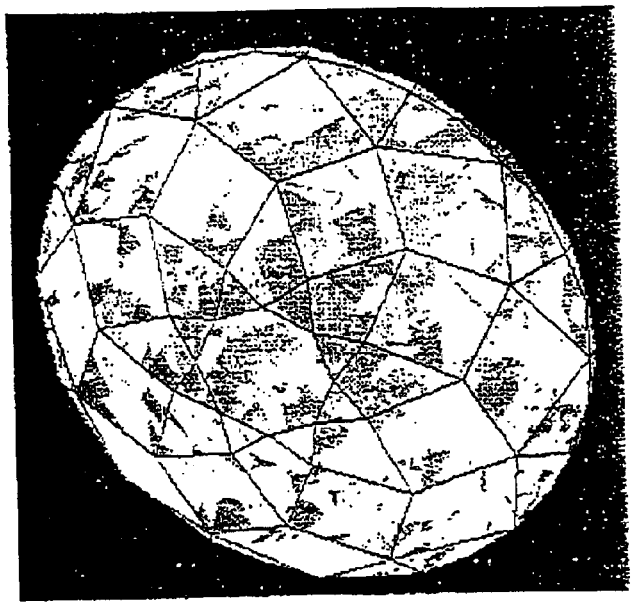
FIG. 5 illustrates a ray-traced model of the gemstone of the present invention.
Figure 6A:
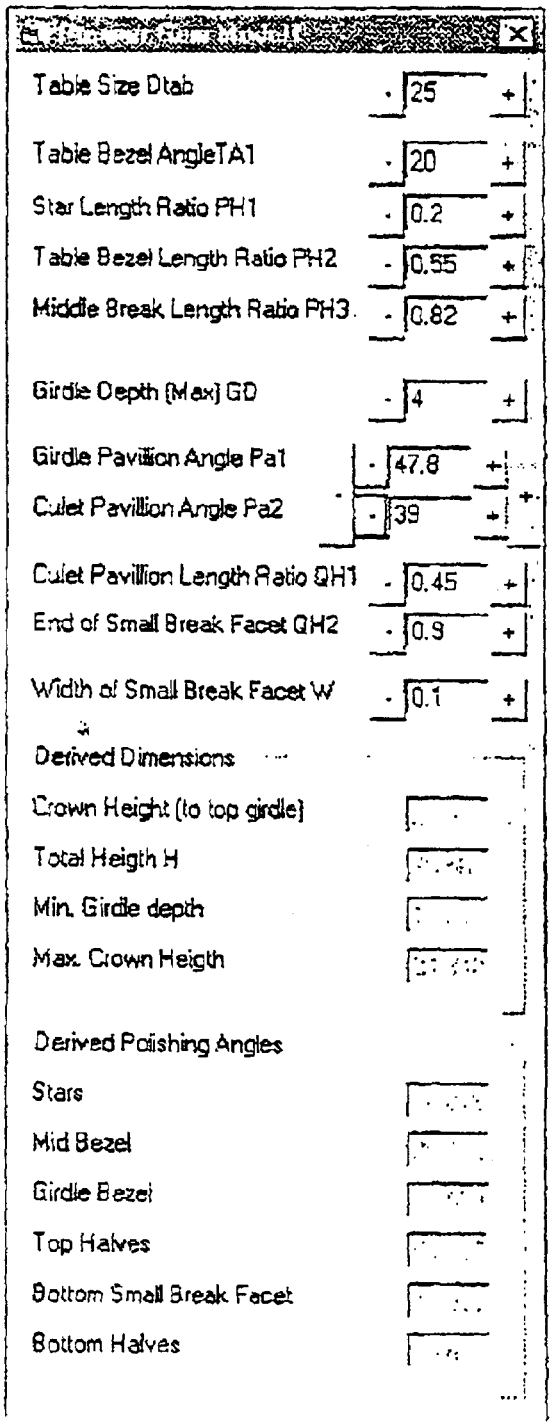

FIG. 5 illustrates a ray-traced model of the preferred embodiment of the gemstone of the present invention. FIGS. 6*a* and 6*b* collectively illustrate various parameters associated with the gemstone of FIG. 5. It should be noted that the depths and heights given in FIG. 6*a* are expressed as a percentage of the diameter. Furthermore, throughout the specification specific angles are provided for various facets with the understanding that these angles cannot be used to restrict the scope of the present invention. The table shown in FIG. 6*b* offers a more specific range associated with each facet of the present invention's gemstone.

Figure 7:
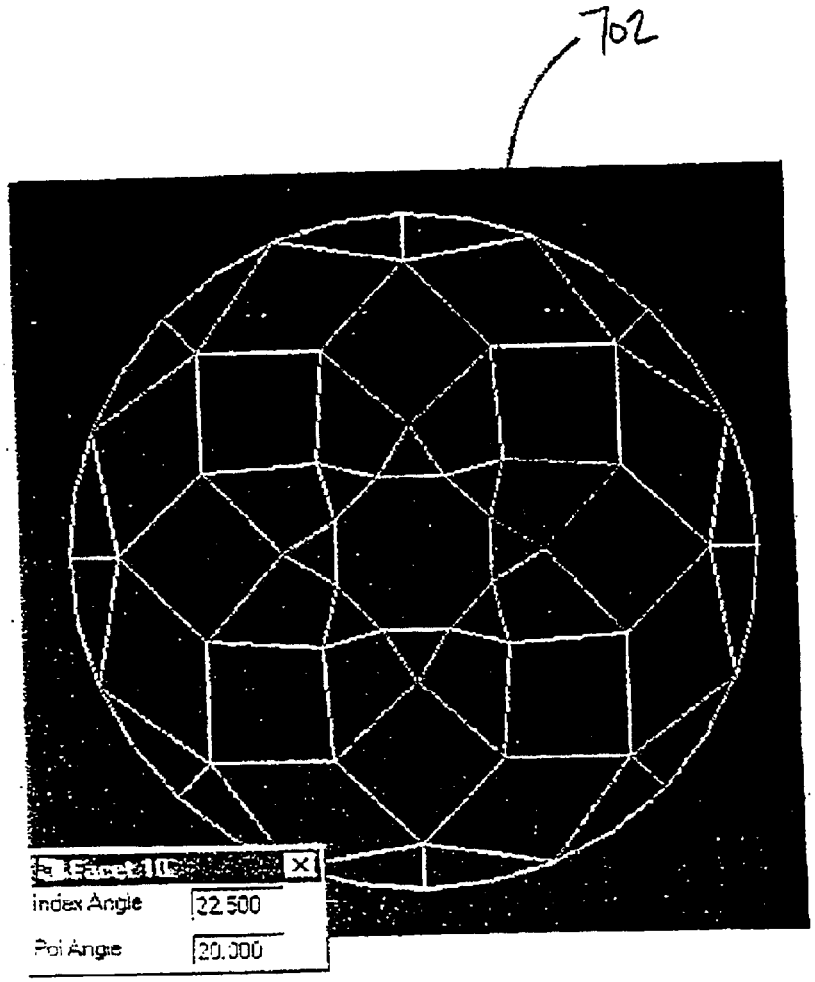
FIG. 7 illustrates a computer generated top view of the gemstone of the present invention showing the polishing angle associated with the kite shaped facet (table bezel).

FIG. 7 illustrates a computer generated top view of the gemstone of the present invention. In this embodiment, the polishing angle of the kite-shaped facet (table bezel angle Ta1) 702 is equal to 20° and the index angle associated with the kites-shaped facet is equal to 22.5°.

Figure 8:
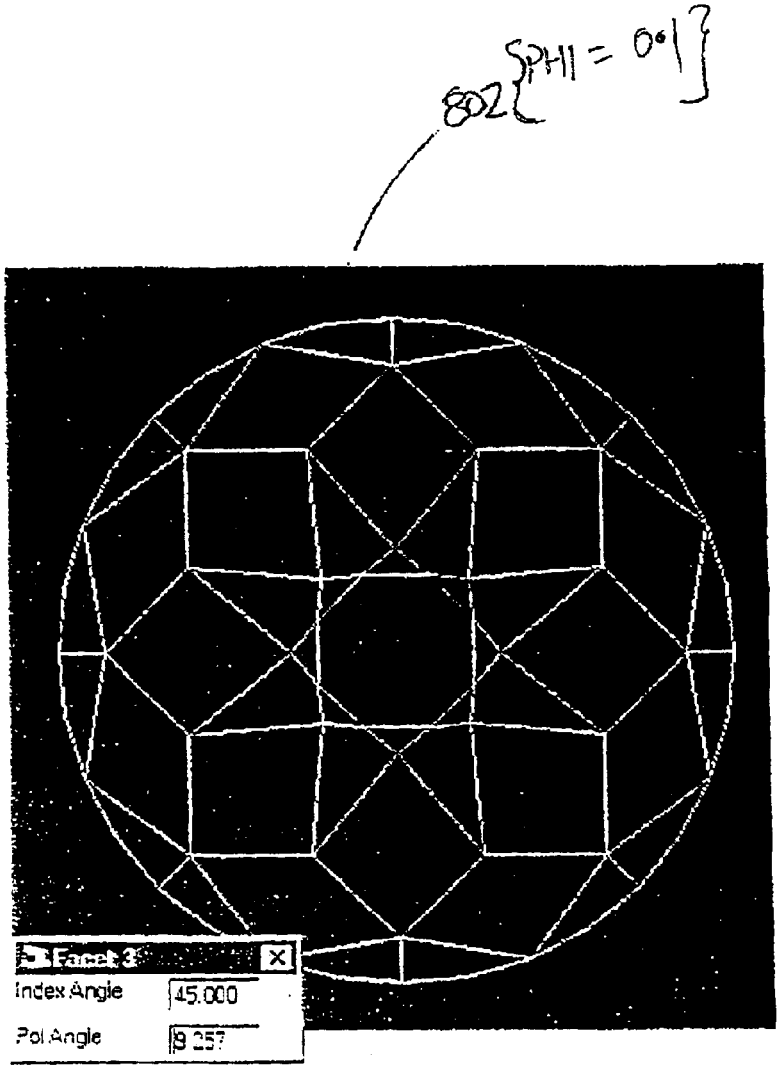
FIG. 8 illustrates another computer generated top view of the gemstone of the present invention with a star length ratio PH1=0.1.

FIG. 8 illustrates another computer generated top view of the gemstone of the present invention with the star length ratio PH1=0.1, wherein PH1 indicates the length of the triangular facets adjoining the table. For example, PH1=0% would mean that the length is 0%, and a value of PH1=100% would make the facet meet the girdle. In this example, the polishing angle associated with the triangular facet 802 is equal to 9.257° and the index angle is equal to 45°.

Figure 9:
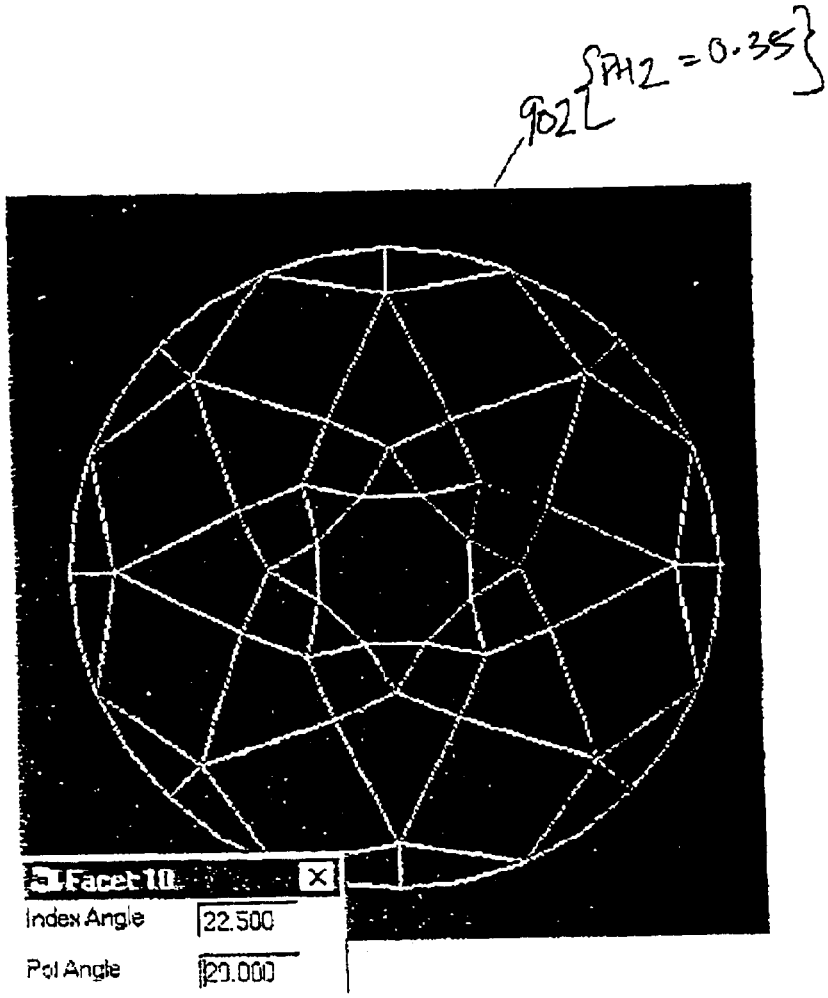
FIG. 9 illustrates yet another computer generated top view of the gemstone with a table bezel length ratio PH2=0.35.

FIG. 9 illustrates another example of the gemstone of the present invention, wherein the table bezel length ratio PH2 equal to 0.35. The ratio PH2 defines the length of the table bezel. As in the other example and as in the preferred embodiment, the polishing angle of the table bezel 902 is equal to 20° and the index angle of the table bezel is equal to 22.5°.

Figure 10:
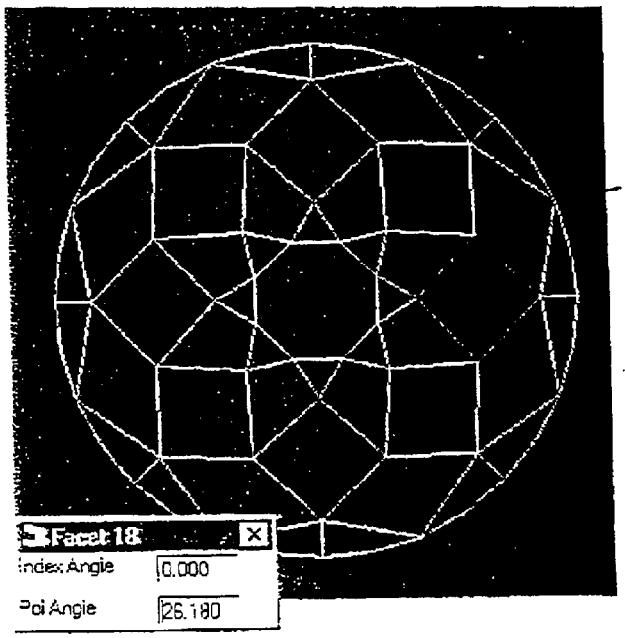
FIG. 10 illustrates the effect of the middle break length ratio parameter PH3 on the model of the present invention.

FIG. 10 illustrates the effect of the middle break length ratio parameter PH3 on the model of the present invention's gemstone. PH3 represents the length of the middle break facet (mid-bezel), wherein the measurement is started from the middle of the table rib. It should be noted that in the preferred embodiment, PH3 is larger than PH1. Furthermore, if the ratio is 1 (corresponding to 100%), then the mid-bezel meets the girdle. FIG. 10 illustrates a specific example wherein PH3=0.82.

Figure 11:
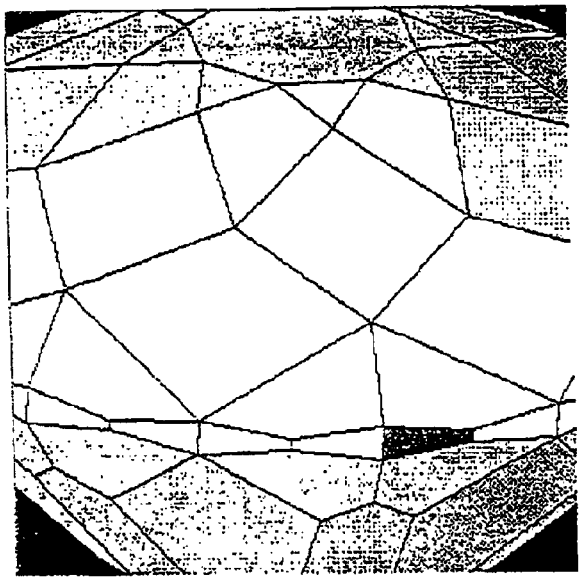
FIG. 11 illustrates a computer generated view showing the girdle of the present invention's gemstone.

FIG. 11 illustrates a computer generated view showing the girdle of the present invention's gemstone. The girdle depth is represented using a percentage of the girdle diameter, which is the maximum distance between the top and bottom girdle points. In the preferred embodiment, the girdle depth ratio is between 3 to 4%.

Figure 12:
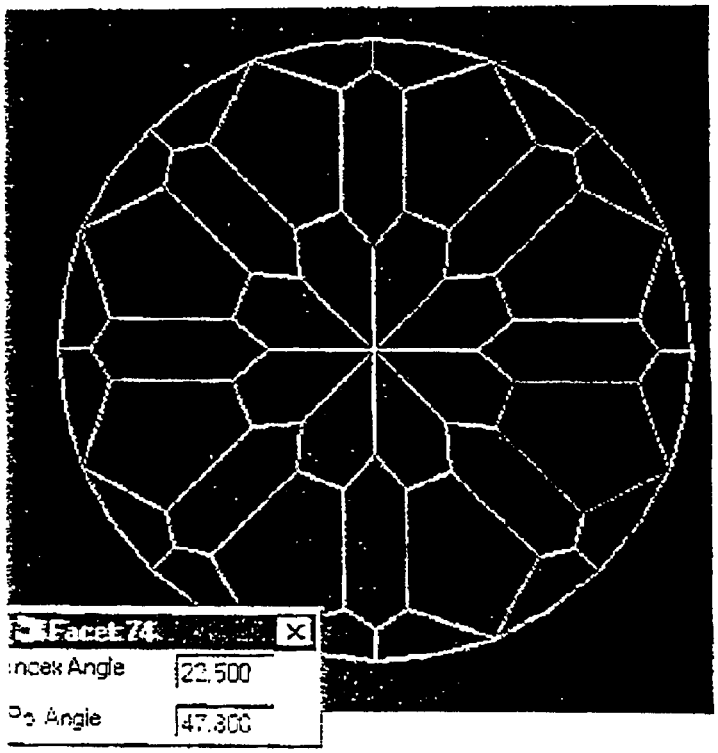
FIG. 12 illustrates a computer generated bottom view of the present invention's gemstone.

FIG. 12 illustrates a computer generated bottom view of the present invention's gemstone. The polishing angle of the pentagon facet on the bottom that meets the girdle is equal to 47.8° and the index angle is equal to 22.5°.

Figure 13:
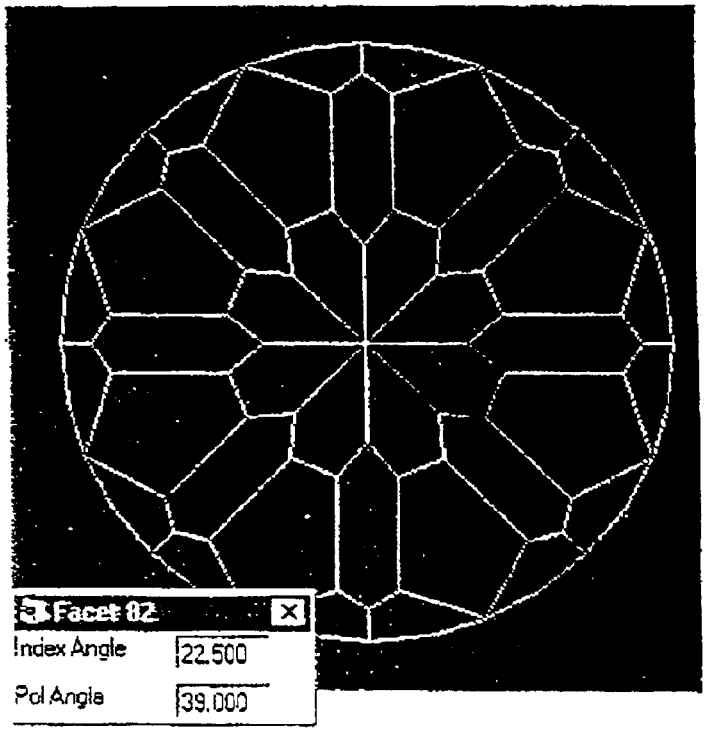
FIG. 13 illustrates another computer generated bottom view of the present invention's gemstone.

FIG. 13 illustrates another computer generated bottom view of the gemstone of the present invention. In this example, the polishing angle of the pentagonal facet on the bottom (Pa2) that meets the culet is equal to 39° and the index angle is equal to 22.5°.

Figure 14:
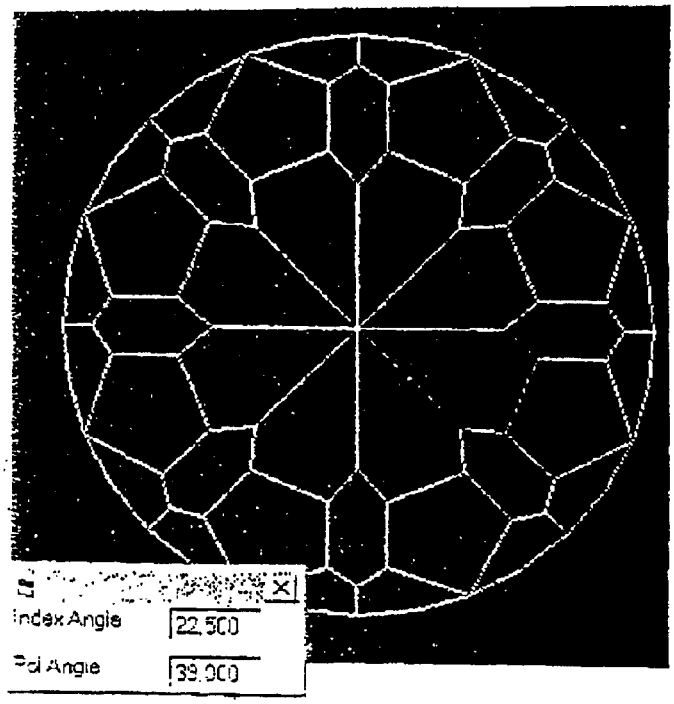
FIG. 14 illustrates a specific example of the pavilion of the gemstone of the present invention wherein the culet pavilion length ratio (QH1) is equal to 0.6.

FIG. 14 yet illustrates another bottom view of the gemstone of the present invention. In this example, the culet pavilion length ratio (QH1), which is expressed as a percentage of the girdle diameter of the pentagonal facet (described in FIG. 13). In this specific example, the culet pavilion length ratio (QH1) is equal to 0.6.

Figure 15:
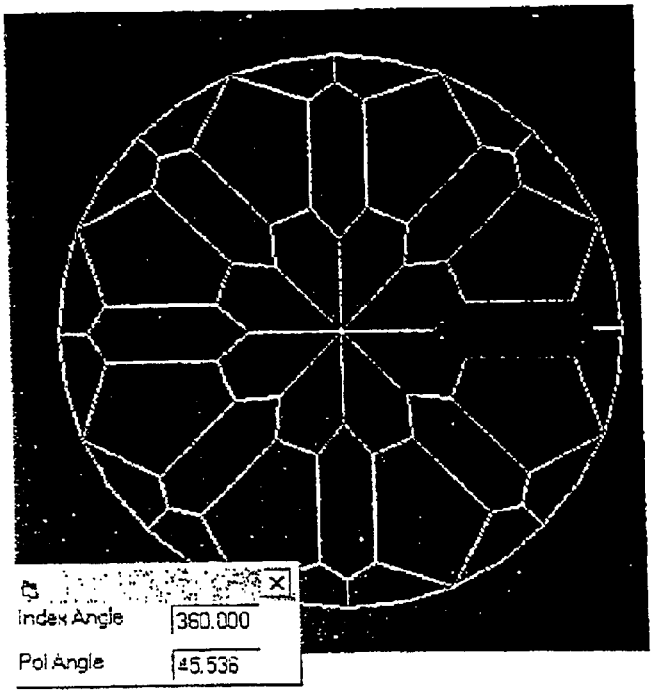
FIG. 15 illustrates a bottom view of the gemstone with the polish angle of the small break facet equal to 45.536°.
Figure 16:
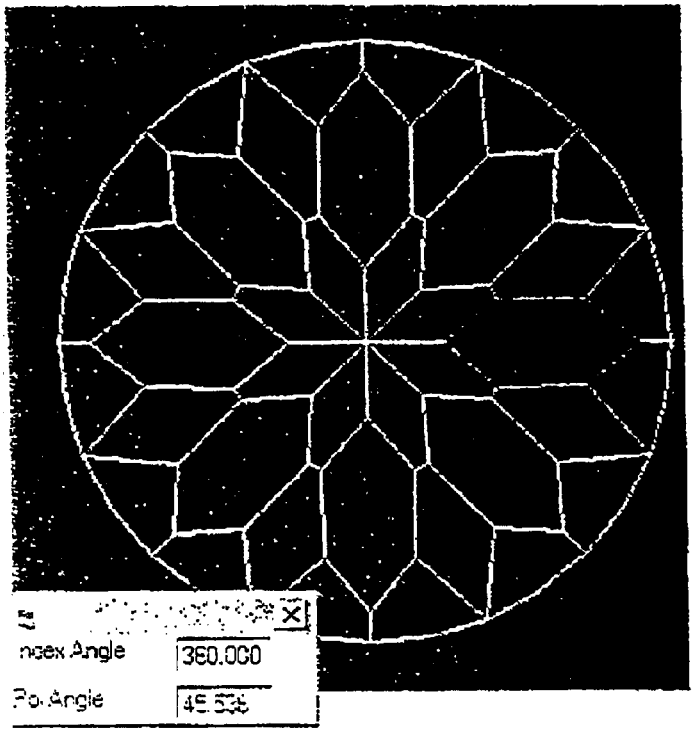
FIG. 16 illustrates the variable width of the small break facet.
Figure 17:
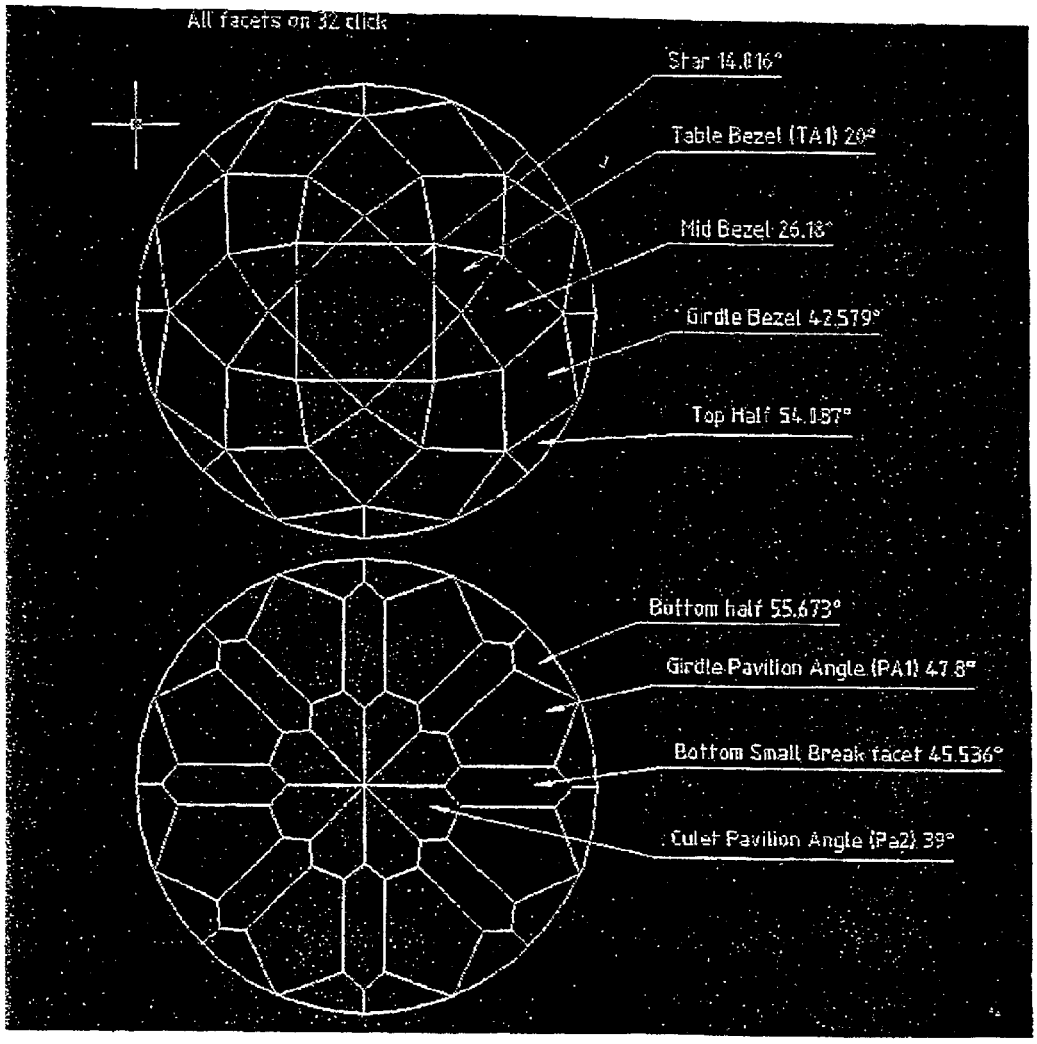
FIG. 17 illustrates various parameters associated with the preferred embodiment of the present invention.

In the bottom view shown in FIG. 15, the polish angle and index angle associated with the small break facet QH2 are 45.536° and 360° respectively. FIG. 16 on the other hand illustrates the variable width of the small break facet. The small break facet is constrained to having two parallel ribs and the distance W between them (measured as a fraction of the girdle diameter). In this specific example, W=0.15. Finally, FIG. 17 illustrates various parameters associated with the preferred embodiment of the present invention.

Figure 18:
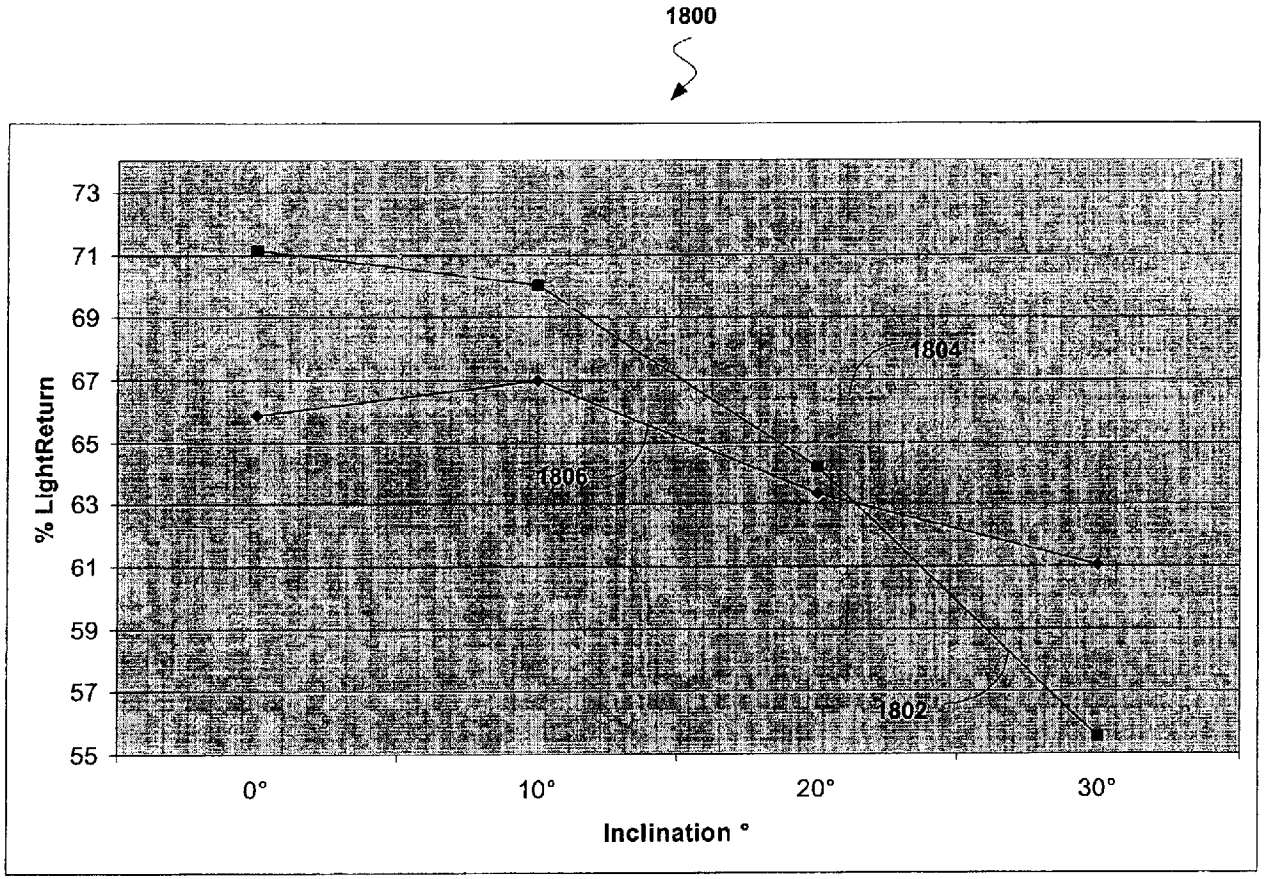
FIG. 18 illustrates a graph showing the improved brilliance of the present invention's gem stone cut.

FIG. 18 illustrates a graph 1800 showing the improved brilliance of the present invention's gem stone cut. The graph 1800 depicts a comparison of light return (expressed as a percentage) between the present invention's gemstone cut 1802, an optimized embodiment of the present invention's gemstone cut 1804, and a hearts and arrows cut 1806. Table 1 provides light return values for various inclination angles.

TABLE 1

| | AvgInt | | | |
|---|---|---|---|---|
| | 0° | 10° | 20° | 30° |
| Hearts and arrows Cut | 65.898 | 67.009 | 63.366 | 61.064 |
| Present Invention's Gemstone Cut | 71.14 | 70.04 | 64.17 | 55.58 |
| Optimised Embodiment | 72.427 | 69.568 | 67.483 | 59.546 |

CONCLUSION

A system and method has been shown in the above embodiments for the effective implementation of a gemstone cut. While various preferred embodiments have been shown and described, it will be understood that there is no intent to limit the invention by such disclosure, but rather, it is intended to cover all modifications and alternate constructions falling within the spirit and scope of the invention, as defined in the appended claims. For example, the present invention should not be limited by type of gemstone or shape of gemstone.

What is claimed is:

1. A gemstone comprising:

a. a crown comprising an octagonal table disposed at the top of said crown, eight triangular star facets each defined by three connected edges, eight quadrangular table bezels each defined by four connected edges, eight quadrangular mid-bezels each defined by four connected edges, and eight quadrangular girdle bezels, said star facets disposed around said octagonal table, said table bezels disposed around and in-between said star facets with each table bezel sharing an edge with each of two star facets, said mid-bezels disposed around and in-between said table bezels with each mid-bezel disposed adjacent to and sharing an edge with each of two table bezels, and said girdle bezels disposed around and in-between said mid-bezels;

b. a pavilion comprising eight concentrically arranged culet pavilion facets, eight bottom small break facets, and eight girdle pavilion facets; and said small break facets and said girdle pavilion facets alternatively disposed around said culet pavilion facets with each culet pavilion facet being bordered by one girdle pavilion facet and two small break facets, and c. a girdle comprising a pair of top half facets and a pair of bottom half facets, and said pair of top half facets disposed around and in-between said girdle bezels and said pair of bottom half facets disposed around and in-between said bottom small break facets and girdle pavilion facets.

2. A gemstone as per claim 1, wherein said gemstone is any of the following: precious gemstone or semi-precious gemstone.

3. A gemstone as per claim 2, wherein said precious gemstone is a diamond.

4. A gemstone as per claim 1, wherein a polishing angle associated with said star facets is between 4° and 16°.

5. A gemstone as per claim 1, wherein a polishing angle associated with said table bezels is between 12° and 24°.

6. A gemstone as per claim 1, wherein a polishing angle associated with said mid-bezels is between 24° and 32°.

7. A gemstone as per claim 1, wherein a polishing angle associated with said girdle bezels is between 36° and 50°.

8. A gemstone as per claim 1, wherein a polishing angle associated with said top half facets is between 47° and 67°.

9. A gemstone as per claim 1, wherein a polishing angle associated with said culet pavilion facets is between 35° and 42°.

10. A gemstone as per claim 1, wherein a polishing angle associated with said bottom small break facets is about 45.536°.

11. A gemstone as per claim 1, wherein a polishing angle associated with said girdle pavilion facets is between 39° and 54°.

12. A gemstone as per claim 1, wherein a polishing angle associated with said bottom half facets is between 50° and 61°.

13. A gemstone with improved brilliance, said gemstone comprising:

a. a crown comprising:

i. an octagonal table forming a top surface of said crown, ii. eight triangular star bezels disposed around said octagonal table at a first angle from said top surface, iii. eight quadrangular table bezels disposed around said star bezels at a second angle from said top surface, said second angle greater than said first angle, and iv. eight quadrangular mid-bezels, each of said mid-bezels disposed between two of said table bezels at a third angle from said top surface, said third angle greater than said second angle, and v. eight quadrangular girdle bezels, each of said girdle bezels disposed between two of said mid-bezels at a fourth angle from said top surface, said fourth angle greater than said third angle;

b. a pavilion, said pavilion further comprising:

i. eight pentagonal culet pavilion facets disposed concentrically at a fifth angle about a bottom, said fifth angle smaller than said fourth angle, ii. eight hexagonal bottom small break facets disposed at a sixth angle from said bottom, and iii. eight pentagonal girdle pavilion facets disposed at a seventh angle from said bottom, said seventh angle being greater than said fifth angle, and said bottom small facets and girdle pavilion facets arranged alternatively around said culet pavilion facets;

c. a girdle, said girdle further comprising:

i. eight triangular left top half facets and eight triangular right top half facets, said top half facets disposed at an eighth angle from said top surface and said top half facets disposed in-between said girdle bezels of said crown; and ii. eight four-sided left bottom half facets and eight four-sided right bottom half facets, said bottom half facets disposed at a ninth angle from said bottom, and each of said bottom surfaces disposed in-between said girdle pavilion facets and said bottom small break facets.

14. A gemstone as per claim 13, wherein said gemstone is any of the following: precious gemstone or semi-precious gemstone.

15. A gemstone as per claim 14, wherein said precious gemstone is a diamond.

16. A gemstone as per claim 13, wherein said first angle is between 4° and 16°.

17. A gemstone as per claim 13, wherein said second angle is between 12° and 24°.

18. A gemstone as per claim 13, wherein said third angle is between 24° and 32°.

19. A gemstone as per claim 13, wherein said fourth angle is between 36° and 50°.

20. A gemstone as per claim 13, wherein said fifth angle is between 35° and 42°.

21. A gemstone as per claim 13, wherein said sixth angle is about 45.536°.

22. A gemstone as per claim 13, wherein said seventh angle is between 39° and 54°.

23. A gemstone as per claim 13, wherein said eighth angle is between 47° and 67°.

24. A gemstone as per claim 13, wherein said ninth angle is between 50° and 61°.

* * * * *